US009740224B2

(12) United States Patent
Atrash et al.

(10) Patent No.: US 9,740,224 B2
(45) **Date of Patent: *Aug. 22, 2017**

(54) DYNAMIC BIASING FOR REGULATOR CIRCUITS

(71) Applicant: TRIUNE IP, LLC, Plano, TX (US)

(72) Inventors: Amer Atrash, Plano, TX (US); Ross E. Teggatz, McKinney, TX (US); Brett Smith, McKinney, TX (US)

(73) Assignee: TRIUNE IP LLC, Plano, TX (US)

( * ) Notice: Subject to any disclaimer, the term of this patent is extended or adjusted under 35 U.S.C. 154(b) by 34 days.

This patent is subject to a terminal disclaimer.

(21) Appl. No.: 14/855,286

(22) Filed: Sep. 15, 2015

(65) Prior Publication Data

US 2016/0004267 A1 Jan. 7, 2016

Related U.S. Application Data

(63) Continuation of application No. 12/814,457, filed on Jun. 13, 2010, now Pat. No. 9,134,741.

(60) Provisional application No. 61/186,831, filed on Jun. 13, 2009.

(51) Int. Cl.

| | |
|---|---|
| ***G05F 3/02*** | (2006.01) |
| ***G05F 1/10*** | (2006.01) |
| ***G05F 1/575*** | (2006.01) |
| ***G05F 1/565*** | (2006.01) |

(52) U.S. Cl.

CPC ..... *G05F 1/575* (2013.01); *G05F 1/565* (2013.01)

(58) Field of Classification Search

CPC ..... G05F 1/465; G05F 3/262; G05F 3/247; G05F 3/24; G11C 5/147

USPC ..... 327/538, 540, 541, 543; 323/273, 280

See application file for complete search history.

(56) References Cited

U.S. PATENT DOCUMENTS

| | | | | |
|---|---|---|---|---|
| 5,939,867 | A | 8/1999 | Capici et al. | |
| 6,104,243 | A | 8/2000 | Viebach | |
| 6,157,176 | A | 12/2000 | Pulvirenti et al. | |
| 6,160,851 | A | 12/2000 | Brown et al. | |
| 6,522,111 | B2 | 2/2003 | Zadeh et al. | |
| 6,897,717 | B1 | 5/2005 | Eddleman et al. | |
| 6,933,772 | B1 | 8/2005 | Banerjee et al. | |
| 7,173,401 | B1 | 2/2007 | Huang | |
| 7,196,563 | B2 | 3/2007 | Yuki et al. | |
| 2001/0030530 | A1 | 10/2001 | Marty | |
| 2003/0085693 | A1 | 5/2003 | Marty | |
| 2003/0147193 | A1 | 8/2003 | Hamon et al. | |
| 2006/0091940 | A1 | 5/2006 | Kimura | |
| 2007/0250555 | A1 | 10/2007 | Piechocki et al. | |
| 2008/0054949 | A1 | 3/2008 | Pera | |
| 2008/0197829 | A1* | 8/2008 | Nagata | G05F 3/262 323/316 |
| 2008/0218137 | A1* | 9/2008 | Okuyama | G05F 1/575 323/273 |
| 2010/0224765 | A1 | 9/2010 | Seitz et al. | |

* cited by examiner

*Primary Examiner* — Quan Tra

(74) *Attorney, Agent, or Firm* — Jackson Walker LLP; Christopher J. Rourk

(57) ABSTRACT

The disclosed invention provides apparatus and methods for dynamic biasing in electronic systems and circuits. The apparatus and methods disclosed provide non-linear biasing responsive to monitored load conditions.

21 Claims, 6 Drawing Sheets

DYNAMIC BIASING FOR REGULATOR CIRCUITS

RELATED APPLICATIONS

This application is a continuation of U.S. patent application Ser. No. 12/814,457, filed Jun. 13, 2010, now U.S. Pat. No. 9,134,741, which claims priority to and benefit of U.S. Provisional Patent Application Ser. No. 61/186,831, filed on Jun. 13, 2009, which is hereby incorporated by reference for all purposes as if set forth herein in its entirety. This application and the Provisional Patent Application have at least one common inventor.

TECHNICAL FIELD

The invention relates to electronic circuits. More particularly, the invention relates to dynamic biasing in electronic regulator systems.

BACKGROUND OF THE INVENTION

Linear regulators exist in many electronic systems and can often play a significant role in reducing overall system power consumption. An ongoing trend in modern electronics design is the requirement for lower power consumption, particularly for portable devices, consumer products, remote devices, energy harvesting applications, and the like. Several architectures exist for creating regulators, but these are often limited in the range of output current they can supply. One of the problems presented by regulators is that the stability of the system is often a function of the load current. Thus, in low power regulators in particular, or regulators designed to handle a wide range of loads, the need for stability is not easily met. In such systems, as the load current increases, the output pole of the regulator tends to increase in frequency, and may compromise regulator stability. It is a significant challenge to design and build an efficient regulator that can nevertheless support a wide output current range. One approach that has been used to create a regulator with a wide range of output current is to set the regulator bias current as a fixed percentage of the output load current. This type of design allows for a wide operating range and low power consumption under light loads, but can result in unnecessarily high power consumption when operating under higher loads.

Due to the foregoing and possibly additional problems, improved apparatus and methods for regulator circuit biasing would be a useful contribution to the arts.

SUMMARY OF THE INVENTION

In carrying out the principles of the present invention, in accordance with preferred embodiments, the invention provides advances in dynamic biasing circuitry and methods particularly advantageous for use in low power applications and in applications having a wide operating range. The embodiments described herein are intended to be exemplary and not exclusive. Variations in the practice of the invention are possible and preferred embodiments are illustrated and described for the purposes of clarifying the invention. All possible variations within the scope of the invention cannot, and need not, be shown.

According to one aspect of the invention, in a preferred embodiment, a method for biasing a circuit includes steps for placing a power regulator in the circuit and adapting the bias current of the regulator to react in response to the output current of the circuit. The method also includes the further step of providing the regulator with a non-linear bias current.

According to another aspect of the invention, a method for biasing circuits as exemplified in the above embodiment also includes the further step of adapting the bias current to respond to the output current in real time.

According to another aspect of the invention, in an example of a preferred embodiment of a system for biasing a circuit including a power regulator that generates and uses a non-linear bias current. The system is configured such that the bias current further adapts in response to the output current of the circuit.

According to another aspect of the invention, a preferred embodiment of a system for biasing a circuit as described above is structured whereby the bias current adapts in response to the output current in real time.

According to another aspect of the invention, in another alternative embodiment, a system for biasing a circuit as described above is configured for adapting the bias current in response to the output current after a selected delay period.

According to yet another aspect of the invention, a low-power regulator circuit including power input and output nodes that connect the regulator with an associated system and a component for monitoring a load signal at the output node. The circuit further includes a biasing component for providing the regulator with a non-linear bias current that adapts in response to the load level.

The invention has advantages including but not limited to providing one or more of the following features: improved response over a range of loads, increased efficiency, and increased stability. These and other advantages, features, and benefits of the invention can be understood by one of ordinary skill in the arts upon careful consideration of the detailed description of representative embodiments of the invention in connection with the accompanying drawings.

BRIEF DESCRIPTION OF THE DRAWINGS

The present invention will be more clearly understood from consideration of the description and drawings in which.

Figure 1:
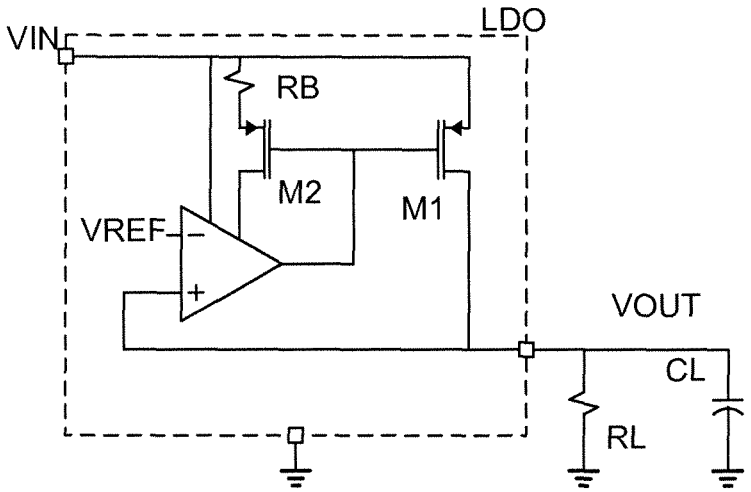
FIG. 1 is a simplified schematic illustrating an example of a preferred embodiment of a dynamic biasing system, method, and circuit.

References in the detailed description correspond to like references in the various drawings unless otherwise noted. Descriptive and directional terms used in the written description such as front, back, top, bottom, upper, side, et cetera, refer to the drawings themselves as laid out on the paper and not to physical limitations of the invention unless specifically noted. The drawings are not to scale, and some features of embodiments shown and discussed are simplified or amplified for illustrating principles and features as well as advantages of the invention.

DESCRIPTION OF PREFERRED EMBODIMENTS

While the making and using of various exemplary embodiments of the invention are discussed herein, it should be appreciated that the apparatus and techniques for its use exemplify inventive concepts which can be embodied in a wide variety of specific contexts. It should be understood that the invention may be practiced in various applications and embodiments without altering the principles of the invention. For purposes of clarity, detailed descriptions of functions, components, and systems familiar to those skilled in the applicable arts are not included. In general, the invention provides systems, methods, and circuits for dynamically biasing regulator circuits in electronics, for example, portable devices. The invention is described in the context of representative example embodiments. Although variations and alternatives for the details of the embodiments are possible, each has one or more advantages over the prior art.

According to preferred embodiments, a dynamic biasing system, method, and circuit modifies the bias current of a regulator so as to improve overall system stability and effectiveness. In a typical regulator, the output pole of the regulator increases in frequency for higher output currents. This increase in pole frequency may compromise regulator stability. A dynamically biased regulator uses a bias current proportional to the output load to adapt to any changes in the power demand of a load attached to the output. As the load's demand for current increases, the bias current also increases. Dynamic biasing improves system stability by adapting any internal poles of the regulator to track output demands. As output current increases, the internal and external poles of the power regulator both shift, increasing the operating range of the entire regulator and improving stability across the entire load range.

In general, the power consumption of the regulator is a direct function of the bias current. When the bias current is a linear, fixed percentage of the output current, this power consumption can become unnecessarily high at high output current levels. It has been discovered that this wasteful power usage is avoided by setting up the circuit in such a way that the bias current is a non-linear function, for example, a logarithmic function or any other non-linear function or combination of non-linear functions as exemplified herein, of the output current. The non-linear relationship serves to keep the bias current low when it is desirable to do so even when the output current is high. In some applications, increased bias current may be used, providing the further advantage of decreasing the overall response time of the regulator to the demands of the load. Preferably, the bias current adapts in real time with respect to the output current. For the purposes of this discussion, the term real time indicates a response time that does not include an intentional delay, which may be useful in selected implementations, e.g., sample and hold.

Figure 2:
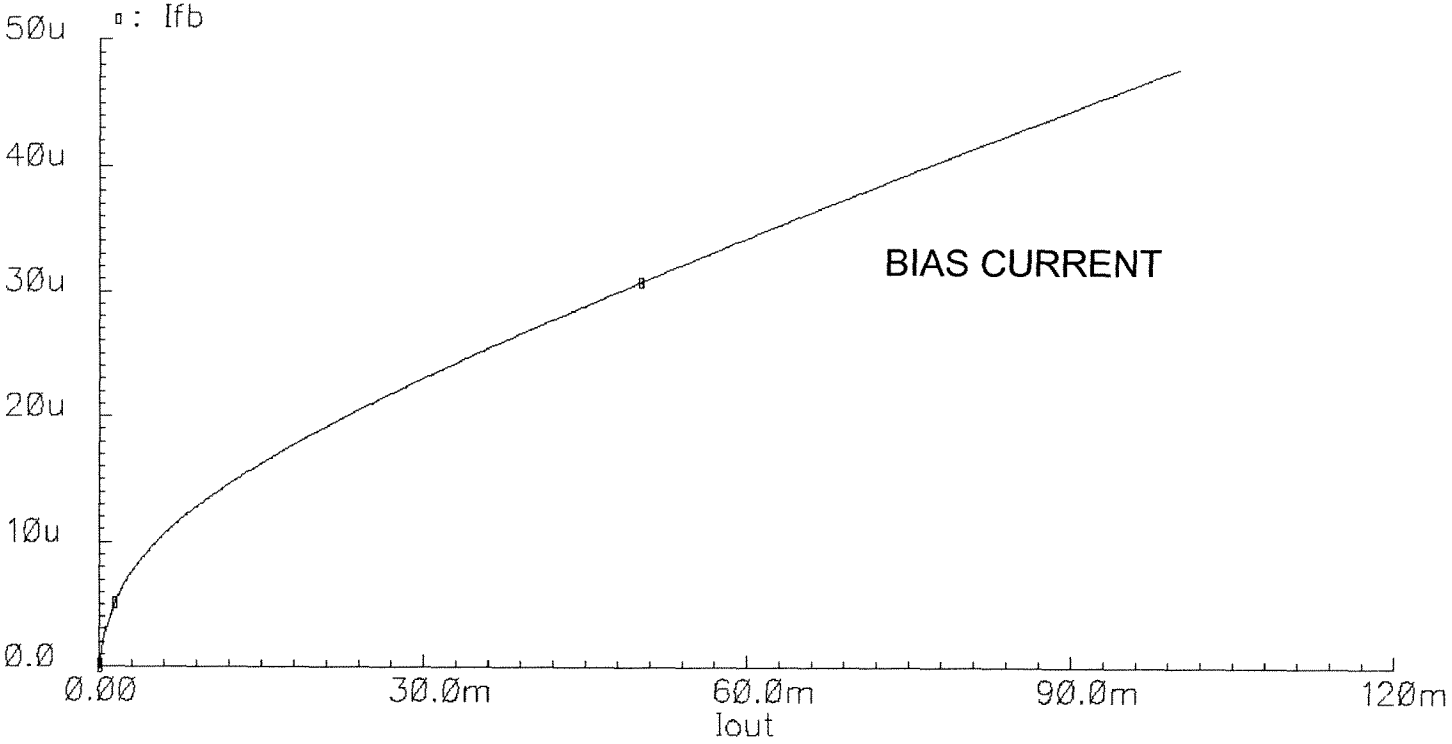
FIG. 2 is a depiction of a biasing function according to an example of the operation of the preferred embodiment of a dynamic biasing system, method, and circuit introduced in FIG. 1.

FIG. 1 shows an example of a preferred embodiment of a regulator system, method, and circuit according to the invention. The system is configured such that the bias current is a non-linear function of the output current. The power regulator, labeled LDO, amplifies the input VIN and provides output VOUT in accordance with the power demands of the load, represented by RL, CL. A load monitoring transistor M1 monitors the output VOUT and allows the regulator to adjust to any changes accordingly. A biasing transistor M2 coupled to a biasing resistor RB serve to dynamically bias the regulator LDO and create a source-degenerated non-linear relationship between the output current and the bias current. This non-linear relationship is described graphically in FIG. 2, which shows a significant decrease in magnitude between the output current and the bias current. For example, as shown, an output current of roughly 55 mA relates to a bias current of only 30 μA.

Figure 3:
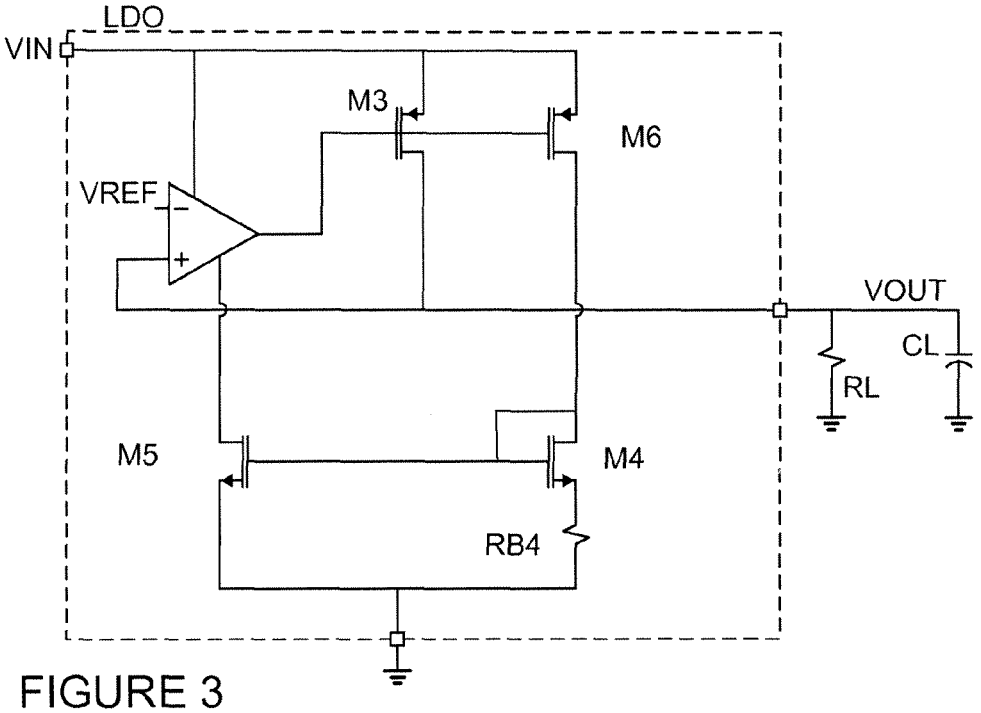
FIG. 3 is a simplified schematic showing an example of an alternative preferred embodiment of a dynamic biasing system, method, and circuit.
Figure 4:
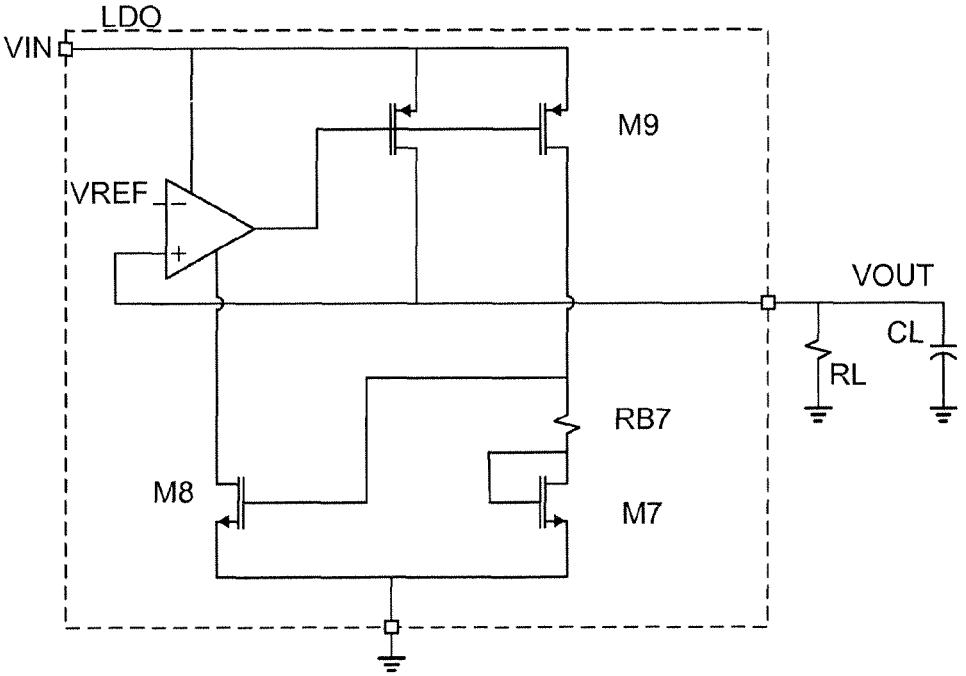
FIG. 4 is a simplified schematic showing an example of another alternative preferred embodiment of a dynamic biasing system, method, and circuit.
Figure 5:
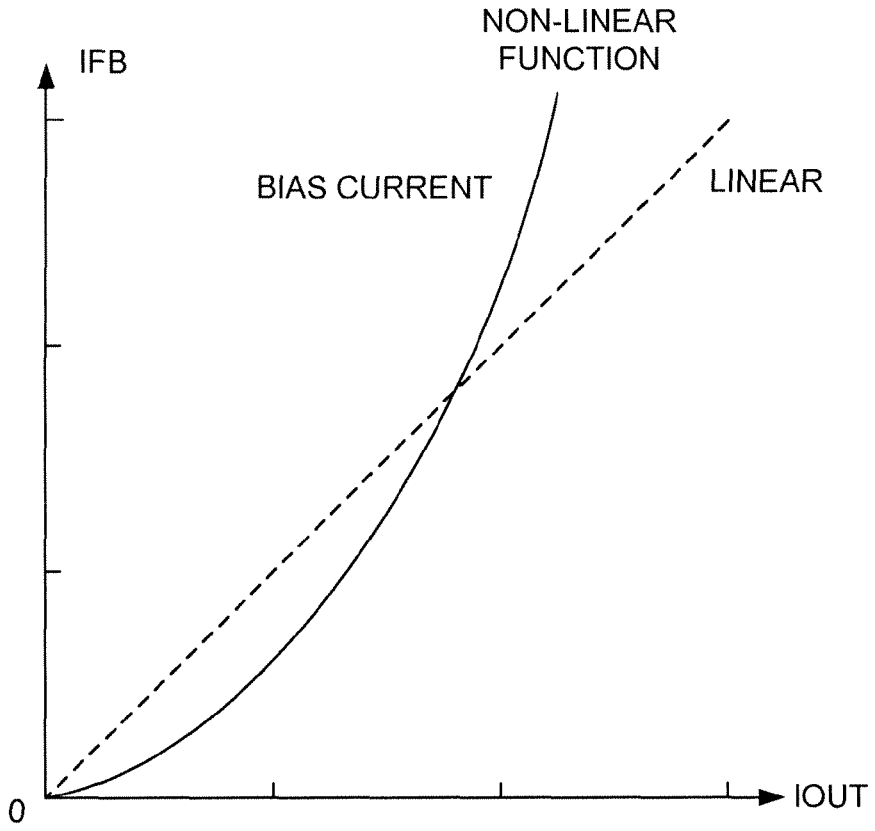
FIG. 5 is a depiction of a biasing function according to examples of the operation of the preferred embodiments of dynamic biasing systems, methods, and circuits introduced in FIGS. 3 and 4.

FIGS. 3 and 4 show additional examples of preferred embodiments of non-liner dynamic biasing circuits and associated methods according to the invention. FIG. 3 shows a load monitoring transistor M3 monitoring VOUT and allowing the regulator LDO to adjust to output changes accordingly. Three biasing transistors M4, M5, and M6, and a biasing resistor RB4, together serve to dynamically bias the regulator and create a non-linear relationship between the output current and the bias current. Now referring to FIG. 4, in an example of an alternative configuration, a biasing resistor RB7 is used in conjunction with the biasing transistors M7, M8, and M9 to dynamically bias the regulator LDO and create a non-linear relationship between the output current and the bias current. As can be seen in these exemplary embodiments, the LDO circuitry may be implemented in various alternative configurations in order to achieve the same functional result. The non-linear relationship achieved in the examples of FIGS. 3 and 4 is depicted graphically in FIG. 5. The examples shown and described herein may in some instances be implemented using different components and substantially equivalent variations of the circuit topologies without departure from the principles of the invention. It should also be understood by those skilled in the arts that elements of the examples may be also be combined in various ways, implementing a biasing function for example, that includes a step response followed by a logarithmic response, or some other combination.

Figure 6:
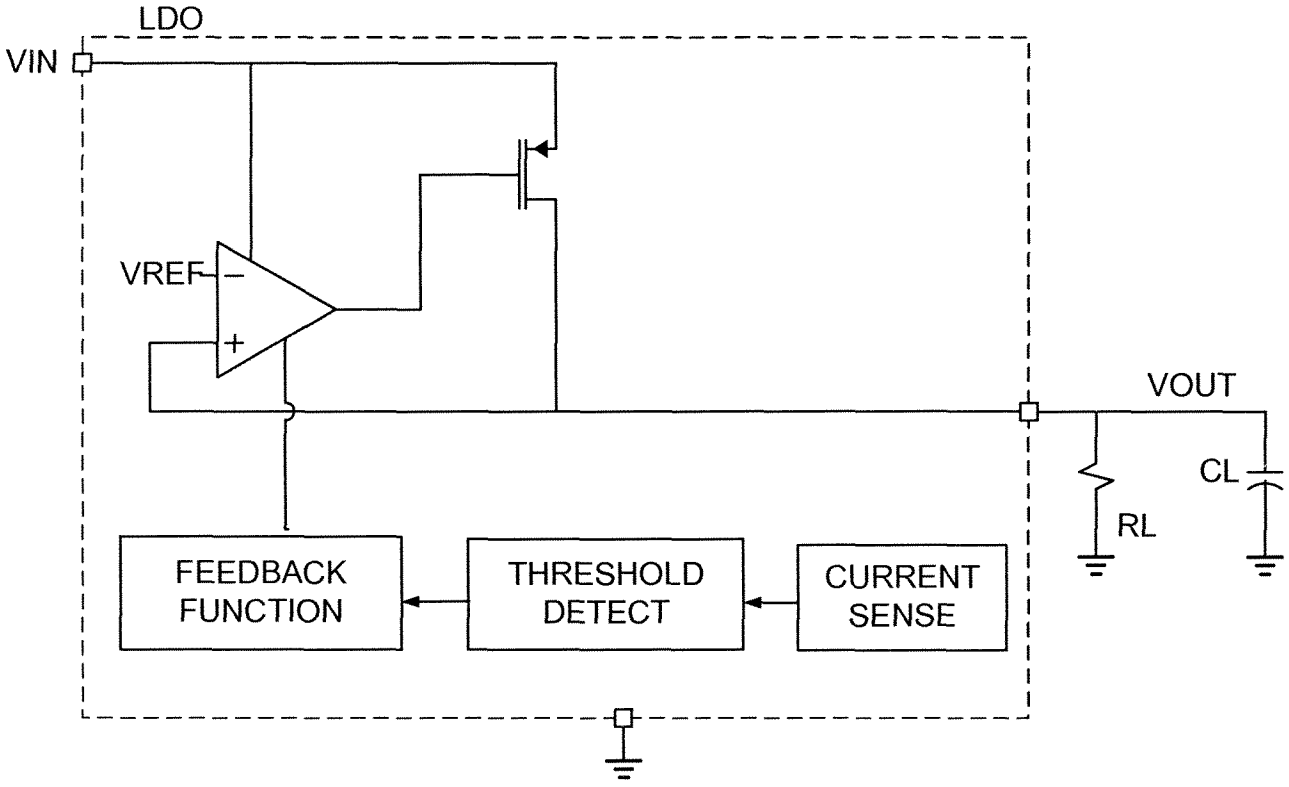
FIG. 6 is a simplified schematic depicting an example of an alternative preferred embodiment of a dynamic biasing system, method, and circuit.
Figure 7:
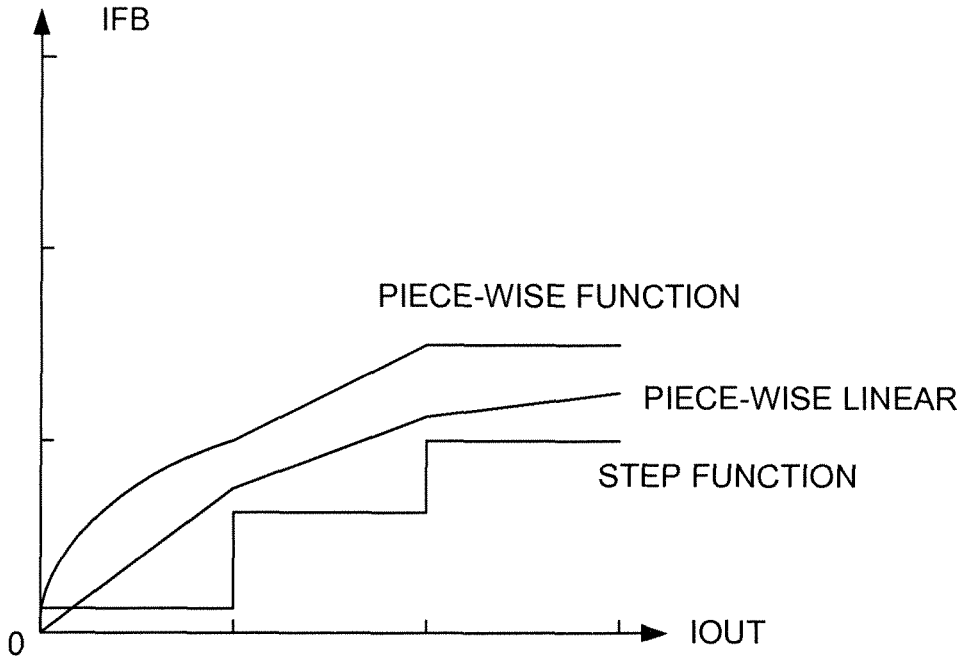
FIG. 7 is a depiction of a biasing function according to an example of the operation of the preferred embodiment of a dynamic biasing system, method, and circuit introduced in FIG. 6.
Figure 8:
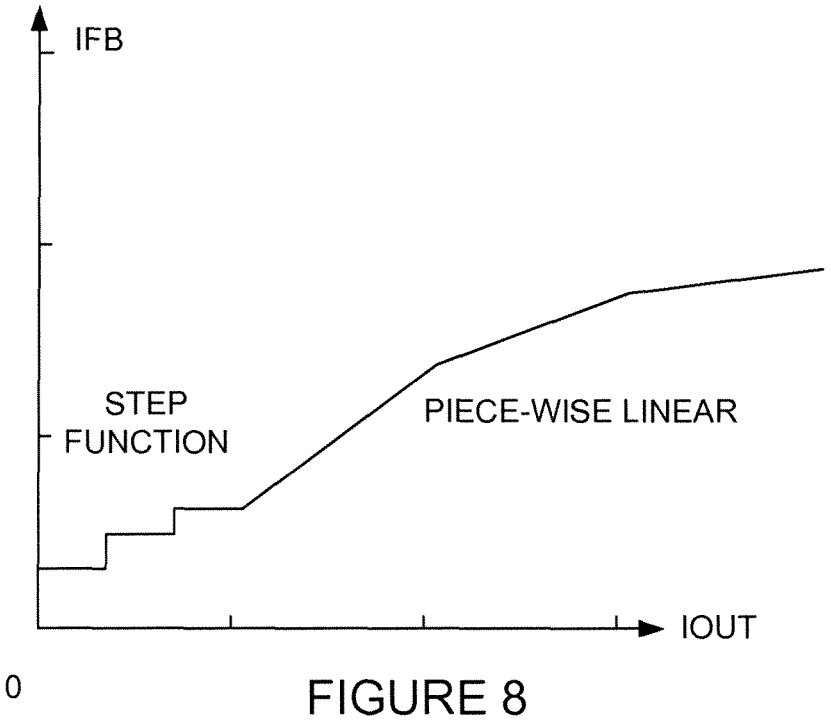
FIG. 8 is a depiction of an alternative biasing function in another example of an implementation of the preferred embodiment of a dynamic biasing system, method, and circuit introduced in FIG. 6.

Another example of an alternative preferred embodiment shown in FIG. 6 uses a current sensing module, which may be configured as a sample and hold mechanism, for example, to dynamically bias the LDO system and create a piece-wise non-linear relationship between the output current and the bias current. The current sensing module senses the output current and conveys this signal to a threshold detecting module. The threshold detecting module compares the detected current to a preselected threshold. A feedback function module then applies a feedback function based on the assigned threshold. Examples of the non-linear biasing relationships are illustrated graphically in FIG. 7, indicating examples of non-linear functions this approach can achieve. This method also provides the capability for the bias current to be clamped at a maximum value and remain constant regardless of output current. An example of a combination of non-linear biasing functions achievable using particular variations of the same general circuit of FIG. 6 are shown graphically in FIG. 8.

The systems, methods, and circuits of the invention provide one or more advantages including but not limited to one or more of; improving the stability of a regulator circuit, especially at high load levels, reducing the power consumption of the regulator and thereby reducing power consumption of the entire system, improving response times of the regulator, and reduced costs. While the invention has been described with reference to certain illustrative embodiments, those described herein are not intended to be construed in a limiting sense. For example, variations or combinations of features or materials in the embodiments shown and described may be used in particular cases without departure from the invention. Although the presently preferred embodiments are described herein in terms of particular examples, modifications and combinations of the illustrative embodiments as well as other advantages and embodiments of the invention will be apparent to persons skilled in the arts upon reference to the drawings, description, and claims.

We claim:

1. A method for biasing a circuit comprising the steps of:

providing a bias current to a regulator;

sensing an output current;

comparing the sensed output current to a preselected threshold; and adjusting the bias current using a piecewise linear and non-linear feedback function in response to the comparison of the sensed output current with the preselected threshold, wherein the adjusted bias current is non-linear with respect to the sensed output current.

2. The method according to claim 1 wherein the step of adjusting the bias current further comprises using a logarithmic function.

3. The method according to claim 1 wherein the step of adjusting the bias current further comprises using at least one step function.

4. The method according to claim 1 wherein the step of adjusting the bias current further comprises using a continuous piecewise function.

5. The method according to claim 1 wherein the step of adjusting the bias current further comprises clamping the bias current at a maximum value.

6. The method according to claim 1 wherein the step of adjusting the bias current further comprises using a source-degenerated non-linear function.

7. A circuit comprising:

a low-power regulator circuit coupled to an associated system;

a load monitoring component configured to sense an output current at an output node; and a biasing component configured to compare the sensed output current to a preselected threshold, and to provide a bias current amplitude that is 1) linear and non-linear with respect to the sensed output current and 2) a linear and non-linear function of the comparison of the sensed output current with the preselected threshold.

8. A circuit according to claim 7 wherein the biasing component is configured to compare the sensed output current to a plurality of preselected thresholds.

9. A circuit according to claim 7 wherein the biasing component is configured to provide a bias current that is linear based on a first comparison of a first threshold and a first sensed output current.

10. A circuit according to claim 7 wherein the load monitoring component further comprises a current sensing module.

11. A circuit according to claim 7 wherein the biasing component further comprises a threshold detecting module.

12. A circuit according to claim 7 wherein the biasing component further comprises a feedback function module.

13. The low-power regulator circuit of claim 7 wherein the biasing component further comprises:

a current sensing circuit configured to generate a current sense output; and a threshold detection circuit configured to receive the current sense output and to generate a threshold detect output.

14. The low-power regulator of claim 7 wherein the linear and non-linear function comprises a first output range that is linear and a second output range that is non-linear.

15. The low-power regulator of claim 7 wherein the linear and non-linear function comprises a first output range that is linear and a continuous second output range that is non-linear.

16. The low-power regulator of claim 7 wherein the linear and non-linear function comprises a first output range that is linear and a second output range that is logarithmic.

17. The low-power regulator of claim 7 wherein the linear and non-linear function comprises a first output range that is linear and a second output range that is asymptotic.

18. The low-power regulator of claim 7 wherein the linear and non-linear function comprises a first output range that is linear and a second output range that is a step function.

19. The low-power regulator of claim 7 wherein the linear and non-linear function comprises a first output range that has a first linear response, a second output range that has a second linear response that is different from the first linear response and a third output range that is non-linear.

20. The low-power regulator of claim 7 wherein the linear and non-linear function comprises a first output range that has a first linear response, a second output range that has a second linear response that is different from the first linear response and a third output range that is a step function.

21. The low-power regulator of claim 7 wherein the linear and non-linear function comprises a first output range that has a first linear response, a second output range that has a second linear response that is different from the first linear response and a third output range that is logarithmic.

* * * * *